US009624620B2

(12) United States Patent
Stamper

(10) Patent No.: US 9,624,620 B2
(45) Date of Patent: Apr. 18, 2017

(54) GRAVITY-FED COMBINED IRON AND STEAMER

(71) Applicant: Hamilton Beach Brands, Inc., Glen Allen, VA (US)

(72) Inventor: George Stamper, Quinton, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 0 days.

(21) Appl. No.: 14/931,937

(22) Filed: Nov. 4, 2015

(65) Prior Publication Data

US 2016/0053429 A1 Feb. 25, 2016

Related U.S. Application Data

(63) Continuation of application No. 14/208,499, filed on Mar. 13, 2014, now Pat. No. 9,200,403.

(51) Int. Cl.

*D06F 75/18* (2006.01)
*D06F 75/20* (2006.01)
*D06F 75/34* (2006.01)

(52) U.S. Cl.

CPC ..... *D06F 75/18* (2013.01); *D06F 75/20* (2013.01); *D06F 75/34* (2013.01)

(58) Field of Classification Search

CPC ..... D06F 75/10; D06F 75/06; D06F 75/18; D06F 75/20; D06F 75/34; D06F 75/265; D06F 87/00; A47L 11/34; D06C 7/00; D06C 2700/13

See application file for complete search history.

(56) References Cited

U.S. PATENT DOCUMENTS 2,530,540 A 11/1950 Reichold et al.
2,713,225 A * 7/1955 Wolcott ..... D06F 81/12 38/75
3,001,305 A 9/1961 Sardeson
3,745,676 A * 7/1973 Dikoff ..... D06F 75/24 38/142
4,357,519 A 11/1982 Bain, Jr.
4,800,661 A * 1/1989 Yamamoto ..... C08K 3/08 38/93
5,390,433 A 2/1995 Brady
5,526,596 A 6/1996 Bitzel et al.
D415,865 S 10/1999 Littmann et al.
D480,524 S 10/2003 Wendt
(Continued)

*Primary Examiner* — Ismael Izaguirre
(74) *Attorney, Agent, or Firm* — Alexander D. Raring

(57) ABSTRACT

An iron includes a housing, a sole plate coupled to the housing and having a plurality of openings formed therein, a water reservoir in the housing, a first steam chamber in selective fluid communication with the water reservoir via a first feed channel, and a heater in thermal communication with the sole plate and the first steam chamber. The heater heats the sole plate and water in the first steam chamber received from the water reservoir to generate steam. A steam nozzle is mounted to the housing and is in fluid communication with the first steam chamber for emitting at least a first volume of the steam. A three-position switch coupled to first and second valves includes a first position where the first and second valves are closed. In a second position, the first valve is open and the second valve is closed. In a third position, the second valve is open and the first valve is closed.

8 Claims, 9 Drawing Sheets

(56) References Cited

U.S. PATENT DOCUMENTS

| | | | | |
|---|---|---|---|---|
| D487,832 | S | 3/2004 | Morrison | |
| D538,991 | S | 3/2007 | Littmann | |
| 7,389,597 | B1 * | 6/2008 | Chen | D06F 75/20 38/77.83 |
| 7,490,422 | B1 * | 2/2009 | Chen | D06F 75/10 38/75 |
| 7,516,565 | B1 * | 4/2009 | Tsen | A47L 13/22 15/321 |
| 7,603,800 | B2 * | 10/2009 | Kubert | D06F 75/18 38/77.83 |
| 8,151,496 | B2 | 4/2012 | Lee et al. | |
| 2006/0081588 | A1 * | 4/2006 | Bowser | D06F 75/265 219/248 |
| 2006/0213092 | A1 * | 9/2006 | Di Leta | D06F 75/12 38/77.1 |
| 2007/0102414 | A1 * | 5/2007 | Jiang | D06F 75/10 219/245 |
| 2012/0131822 | A1 * | 5/2012 | Pan | D06F 87/00 38/3 |
| 2012/0324768 | A1 | 12/2012 | Janakiraman et al. | |

* cited by examiner

GRAVITY-FED COMBINED IRON AND STEAMER

This application is a continuation of pending U.S. patent application Ser. No. 14/208,499, filed Mar. 13, 2014.

BACKGROUND OF THE DISCLOSURE

An embodiment of the present disclosure relates generally to a combined iron and steamer appliance, and more particularly, to a combined iron and steamer appliance wherein water for the steamer is fed by gravity and provides continuous steam generation.

Irons are known for pressing and removing wrinkles from fabric. However, certain delicate garments cannot be ironed because of the likelihood of damage. Steam irons are also used to contact a sole plate to a garment but apertures in the soleplate are used to transmit steam to the garment. However, to remove wrinkles from delicate garments or to generally avoid using a soleplate and/or ironing board, a steamer is typically used. The steamer is a device that emits steam toward the garment but does not typically directly contact the garment. More recently, irons and steamers have been combined into a single device for convenience of the user. Such combined iron/steamer devices require a motor and pump to transfer water from a water reservoir in the device to a steam chamber, where the water comes into contact with a heater to generate the steam. With the motor and pump, a high flow rate is achieved to provide a constant steam flow toward the garment.

At a minimum, the motor and pump of known combined iron/steamers present a significant cost increase to manufacturing of the combined steamer/iron device. However, without the motor and pump, pressure builds in the steam chamber as the water is turned into steam. The result is back pressure that slows the flow rate of the water or causes intermittent flow of the water into the steam chamber. Without a steady water flow rate, the user is left with periodic puffs of steam being emitted from the device rather than a constant stream.

It is desirable to provide a combined iron and steamer device that feeds water into the steam chamber via gravity thereby eliminating the motor and pump but that also provides a continuous flow of steam.

BRIEF SUMMARY OF THE DISCLOSURE

Briefly stated, an embodiment of the present disclosure comprises an iron including a housing, a sole plate coupled to the housing and having a plurality of openings formed therein, a water reservoir located within the housing, a first steam chamber in selective fluid communication with the water reservoir via a first feed channel, and a heater in thermal communication with the sole plate and the first steam chamber. The heater is configured to heat the sole plate and water in the first steam chamber received from the water reservoir to generate steam. A steam nozzle is mounted to the housing and is in fluid communication with the first steam chamber for emitting at least a first volume of the steam generated in the first steam chamber. A feedback tube extends between the first steam chamber and the water reservoir for passing at least a second volume of the steam generated in the first steam chamber to the water reservoir.

In another embodiment, the subject device may comprise a steamer without an iron function where the steamer does not comprise a pump. Similarly, the present disclosure could be embodied by a steam iron with increased steam flow over conventional steam irons without comprising a steamer function.

BRIEF DESCRIPTION OF THE SEVERAL VIEWS OF THE DRAWINGS

The foregoing summary, as well as the following detailed description of a preferred embodiment of the disclosure, will be better understood when read in conjunction with the appended drawings. For the purpose of illustration, there is shown in the drawings an embodiment which is presently preferred. It should be understood, however, that the disclosure is not limited to the precise arrangements and instrumentalities shown.

In the drawings.

DETAILED DESCRIPTION OF THE DISCLOSURE

Figure 1:
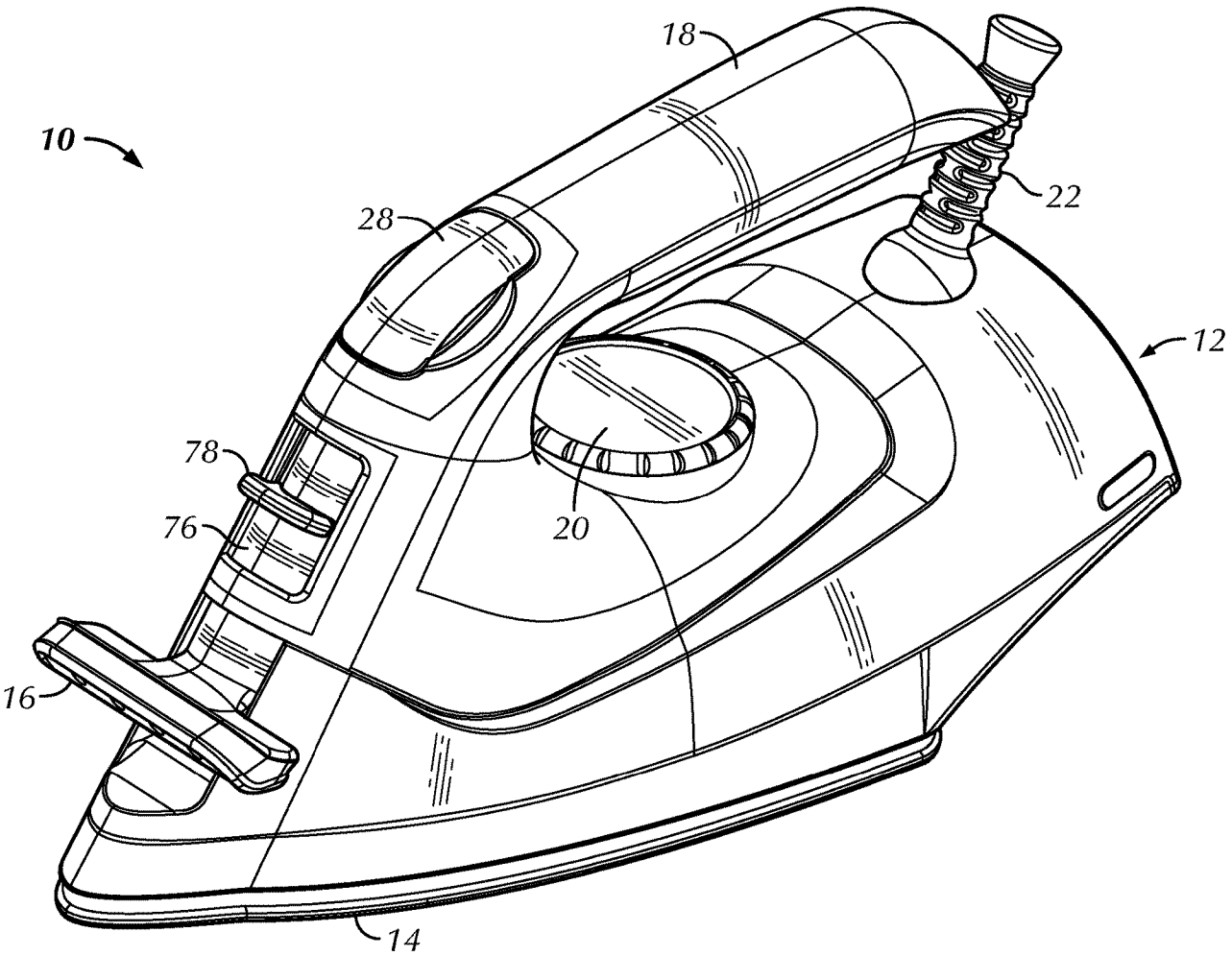
FIG. 1 is a top front side perspective view of an iron in accordance with a first preferred embodiment of the present disclosure.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the device and designated parts thereof. The terminology includes the above-listed words, derivatives thereof, and words of similar import. Additionally, the words "a" and "an", as used in the claims and in the corresponding portions of the specification, mean "at least one."

Referring to the drawings in detail, wherein the same reference numerals indicate like elements throughout, there is shown in FIG. 1 an iron, generally designated 10, in accordance with a preferred embodiment of the present disclosure. The iron 10 includes a housing 12 and a sole plate 14 coupled thereto, as are conventionally known. The housing 12 is preferably formed of multiple components (as will be described below) and is preferably made of a heat insulating polymer or ceramic material. The sole plate 14 is preferably made from a metal, such as aluminum, stainless steel, or the like. The iron 10 further includes a steam nozzle 16 mounted to the housing 12 for performing steaming operations, as will be described in further detail below. The housing 12 preferably includes a handle 18, at least a portion of which runs generally parallel to an orientation of the sole plate 14. For normal ironing operations, a user grasps the handle 18 and applies the sole plate 14 to a garment on an ironing board or other support surface (not shown), as is conventionally known.

The iron 10 may further include a temperature control dial 20 that allows the user to select a desired temperature. The temperature control dial 20 may be a rotary dial and includes markings (not shown) that indicate the selected temperature. The markings are preferably provided in terms of the material of the garment to be ironed (e.g., cotton, polyester, or the like), although color coding, numerals, or the like may be used as well. The iron 10 preferably also includes a cord cover 22 protruding from a rear of the housing 12 for accommodating a power cable (not shown) for providing electrical power to the iron 10 during operation. Other conventional features, such as indicator lights, grips, or the like (not shown) may also be used with the iron 10.

Referring to FIGS. 2-6, a water reservoir 24 is located within the housing 12 for storing water (not shown) for use during steam iron or steaming operations. The water reservoir 24 is preferably a generally sealed, irregularly shaped tank accounting for a large portion of the volume bounded by the housing 12. The water reservoir 24 may even extend into a portion of the handle 18 in order to increase the volume and to increase the time between user filling of the water reservoir 24. The user can pour water into the water reservoir 24 via an inlet 26 in fluid communication therewith. A fill cover 28 preferably seals the inlet to prevent leakage during operation and/or storage of the iron 10. The fill cover 28 may be separately coupled to the housing 12 to prevent loss of the fill cover 28 during filling.

A heater 30 is provided in thermal communication with the sole plate 14 to heat the sole plate 14 for ironing operations. The heater 30 is preferably a resistive heating element placed in close physical proximity with the sole plate 14. In a preferred embodiment, the sole plate 14 includes a sealed heater channel 32 that receives the heater 30 and includes openings 34 allowing a portion of the heater 30, or a connection thereto, to extend into the housing 12 to receive power. Other arrangements of the heater 30 in the sole plate 14 or in the housing 12 may be used as well.

The iron 10 further includes a first steam chamber 36 in selective fluid communication with the water reservoir 24 via a first feed channel 38 and in thermal communication with the heater 30. The first steam chamber 36 is also in fluid communication with the steam nozzle 16 such that water received in the first steam chamber 36 from the water reservoir 24 is converted to steam by the heater 30 and emitted through the steam nozzle 16. To form the first steam chamber 36, the sole plate 14 may include a side wall 40 extending generally perpendicularly therefrom, which is preferably coupled to a chamber plate 42 to create a generally sealed reservoir for holding the water and steam. The first steam chamber 36 is preferably at least slightly larger proximate the outlet of the first feed channel 38 in order to accommodate water incoming from the water reservoir 24. The first steam chamber 36 thereafter preferably narrows and winds toward a steam feed channel 44 that provides the steam to the steam nozzle 16. In a preferred embodiment, the first steam chamber 36 follows a contour of the heater 30, and in this instance is located directly above portions of the heater channel 32. This arrangement allows for more and enhanced heat transfer to the water.

It is further comtemplated that the iron 10 be capable of a steam ironing operation in addition to pure steaming through the steam nozzle 16. To that end, the sole plate 14 includes a plurality of openings 46 distributed at spaced locations therein to allow the flow of steam when the sole plate 14 is pressed against a garment, as is conventionally known. In a preferred embodiment, the iron 10 further includes a second steam chamber 48 in selective fluid communication with the water reservoir 24 via a second feed channel 50 and in thermal communication with the heater 30. The second steam chamber 48 is also in fluid communication with the plurality of openings 46 of the sole plate 14 such that water received in the second steam chamber 48 from the water reservoir 24 is converted to steam by the heater 30 and emitted through the plurality of openings 46 of the sole plate 14.

Like the first steam chamber 36, the second steam chamber 48 is preferably formed by the side wall 40 and the chamber plate 42 to create a generally sealed reservoir for holding the water and steam. The second steam chamber 48 is preferably larger proximate the outlet of the second feed channel 50 in order to accommodate water incoming from the water reservoir 24. The second steam chamber 48 thereafter preferably narrows and winds around the sole plate 14 to each of the plurality of openings 46 therein. In a preferred embodiment, the second steam chamber 48 and the plurality of openings 46 in the sole plate 14 generally follow a contour of the heater 30.

Figure 2:
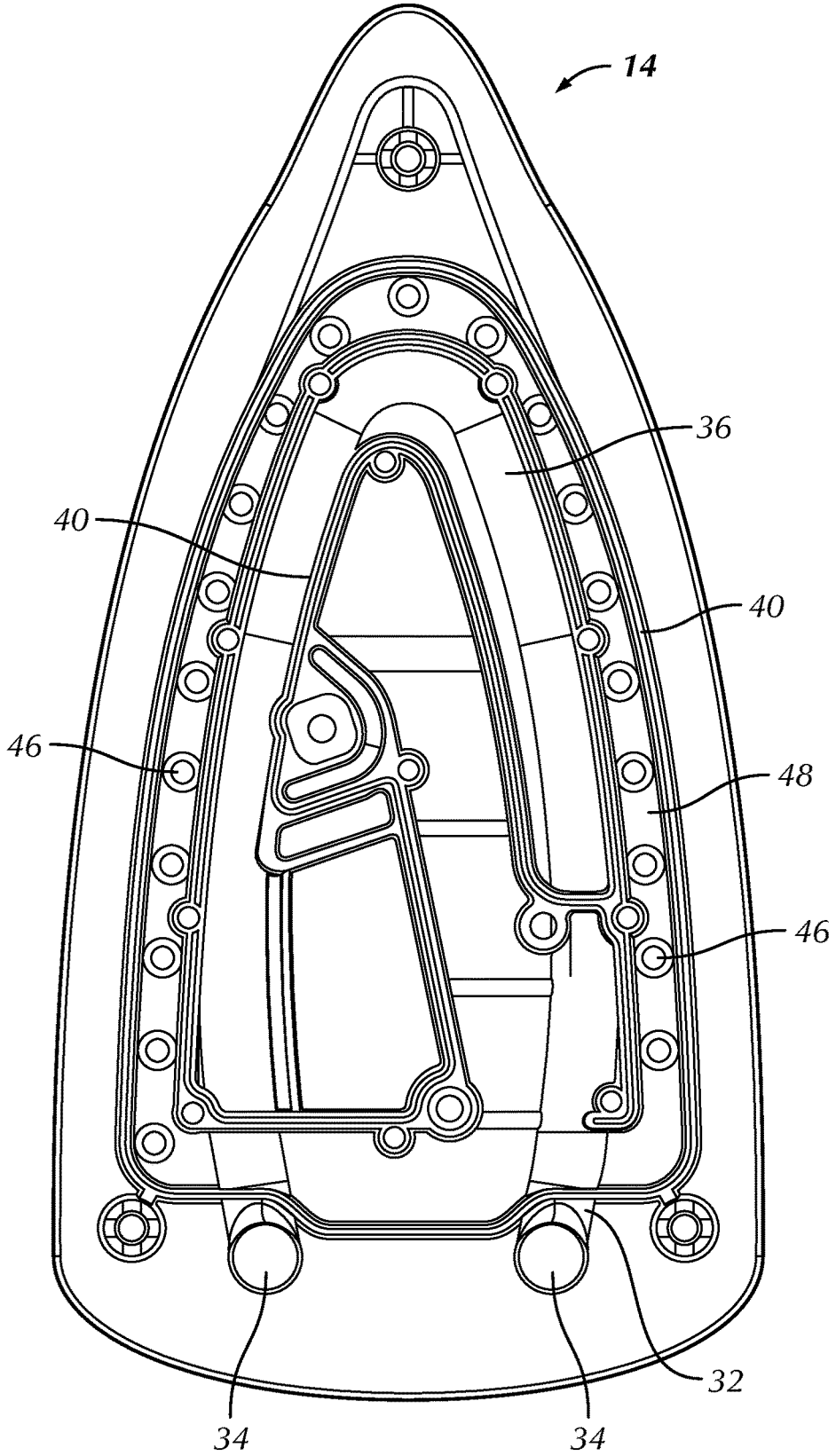
FIG. 2 is a top plan view of a sole plate of the iron of FIG. 1.
Figure 3:
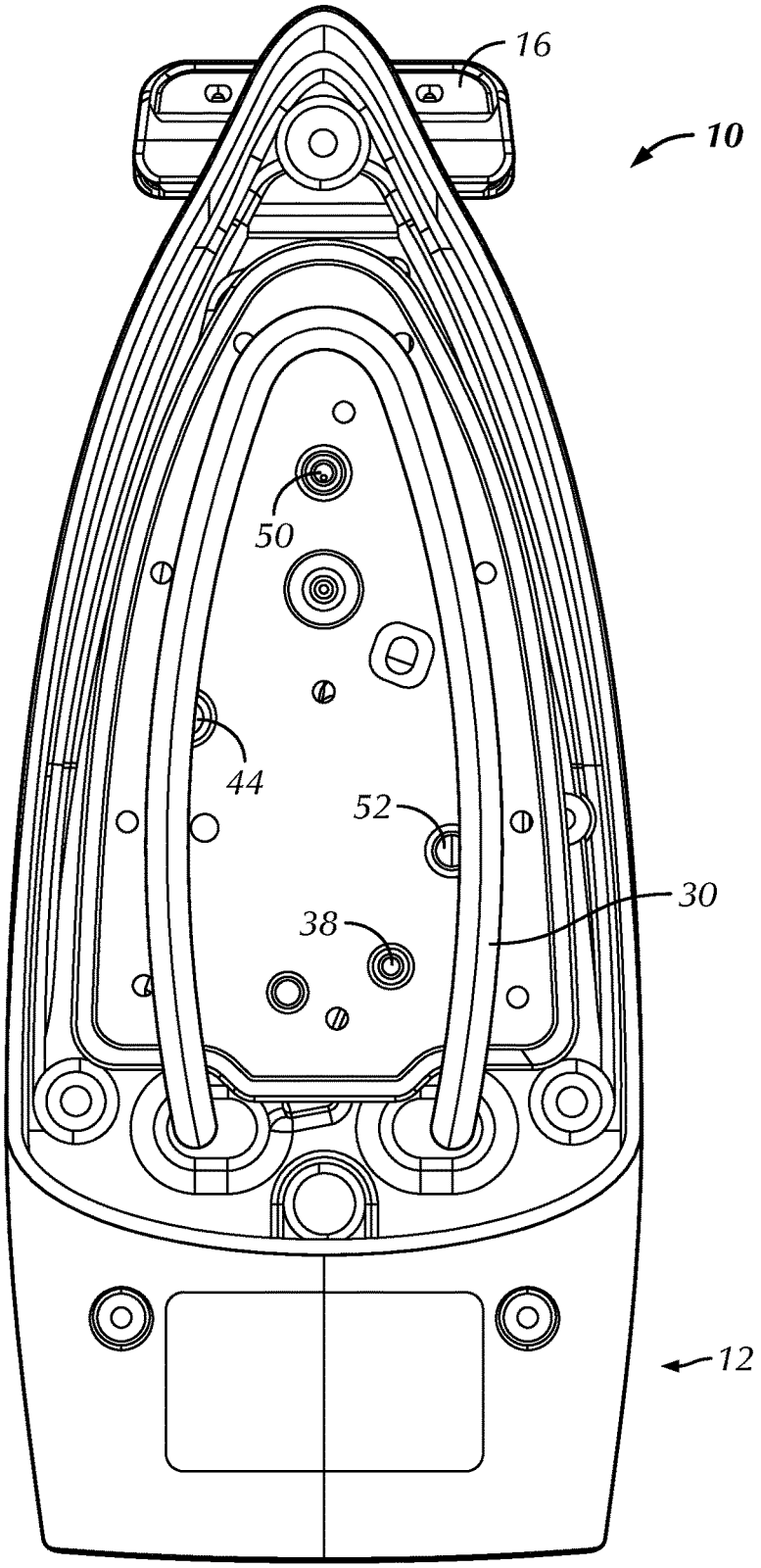
FIG. 3 is a bottom plan view of the iron of FIG. 1 with the sole plate removed.
Figure 4:
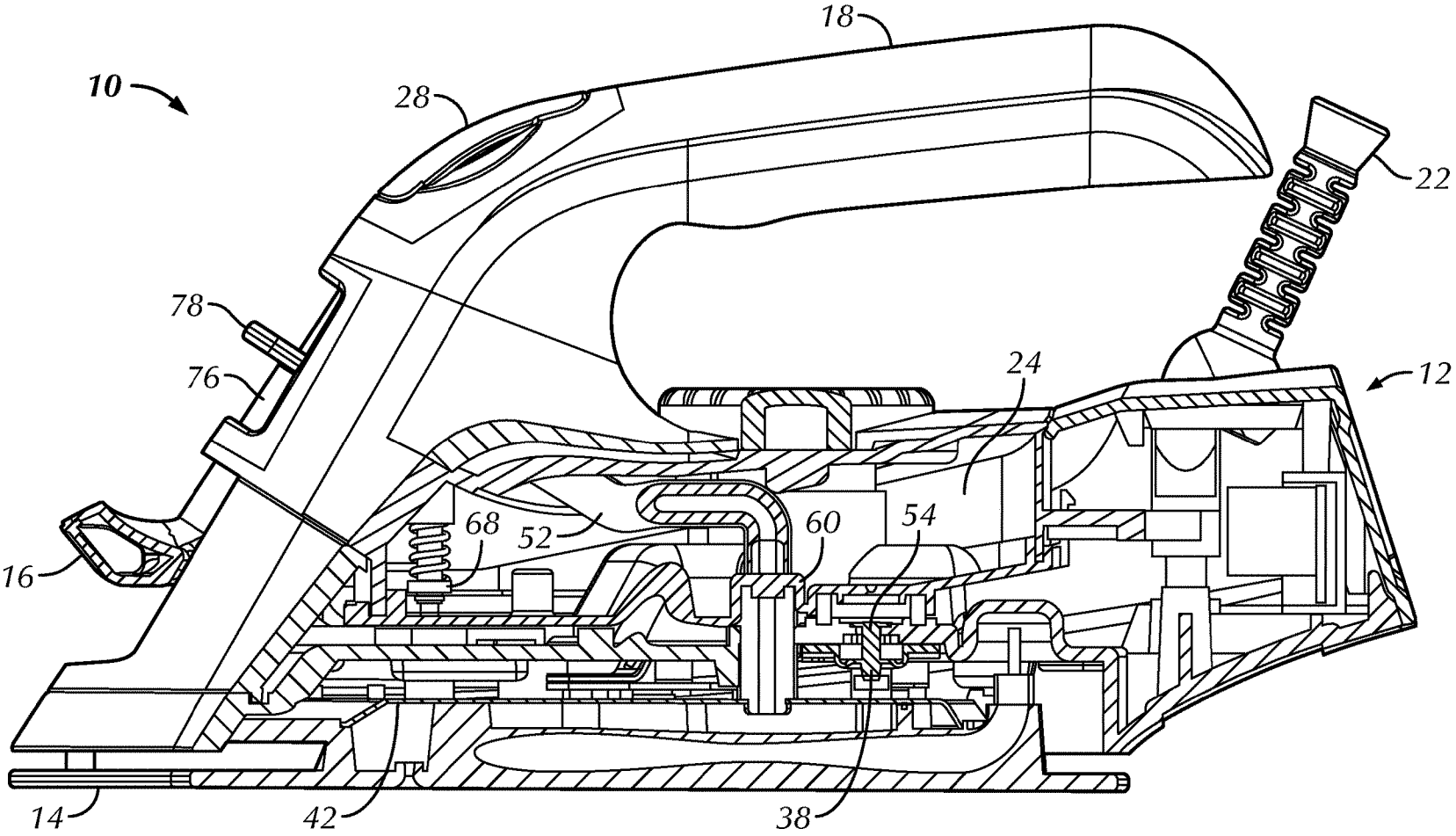
FIG. 4 is a cross-sectional left side elevational view of the iron of FIG. 1.
Figure 5:
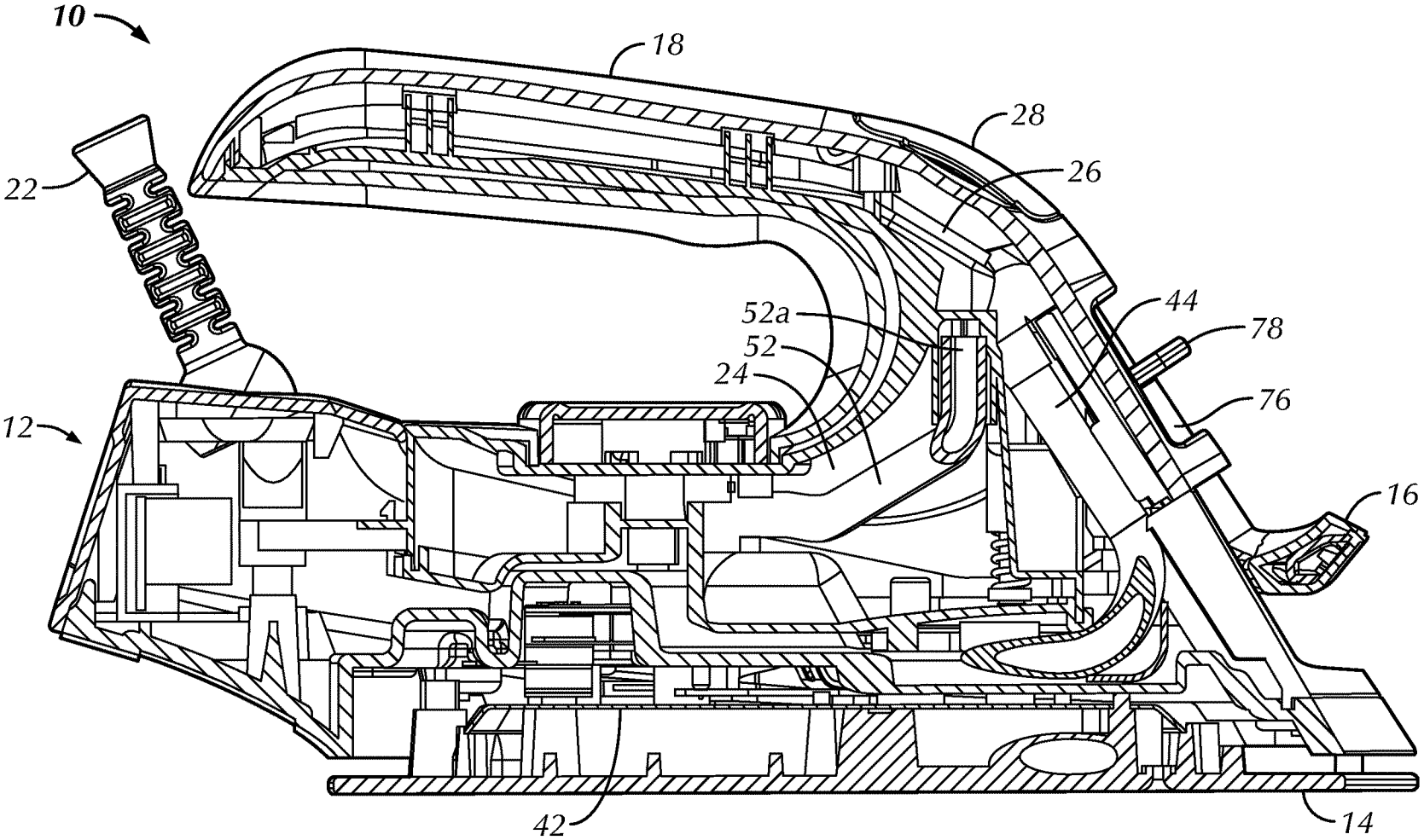
FIG. 5 is a cross-sectional right side elevational view of the iron of FIG. 1.

The first and second steam chambers 36, 48, as can be seen in FIG. 2, are preferably intertwined with one another, but are kept physically separate. Alternatively, the steam nozzle 16 and the plurality of openings 46 in the sole plate 14 may be fed with steam from a single steam chamber, although structure would be needed to divert the steam to the appropriate outlet.

Water from the water reservoir 24 is preferably fed through the first feed channel 38 into the first steam chamber 36 by gravity. As the water flashes to steam in the steam chamber, pressure builds in the chamber. A novel feedback tube 38 is used to prevent back pressure from slowing the water flow through the first feed channel 38. The feedback tube 52 extends between the first steam chamber 36 and the water reservoir 24. In this way, a volume of the steam generated in the first steam chamber 36 is passed back to the water reservoir 24. The pressure is equalized between the first steam chamber 36 and the water reservoir 24. As a result, flow through the first feed channel 38 can be maintained at a generally constant rate, creating a more continuous steam flow from the steam nozzle 16. Stated another way, the pressure upstream and downstream of the first feed channel is equalized so as to maintain a contanst flow of water.

In addition, the volume of steam passed back into the water reservoir 24 via the feedback tube 52 preheats water in the water reservoir 24. This provides the advantage of easier heating once the water enters the first steam chamber 36 and prevents the known negative thermal impact of cold water contacting heated portions of the sole plate 14.

An outlet 52*a* of the feedback tube 52 is preferably positioned in the water reservoir 24 at a predetermined distance or height from the sole plate 14. In this way, when the iron 10 is being used for traditional or steam ironing, water in the water reservoir 24 is prevented from entering into the feedback tube 52 when the sole plate 14 is oriented parallel to a support surface. Otherwise water could leak into the first steam chamber 36 to provide unintentional steam release from the steam nozzle 16 during normal ironing.

Figure 8:
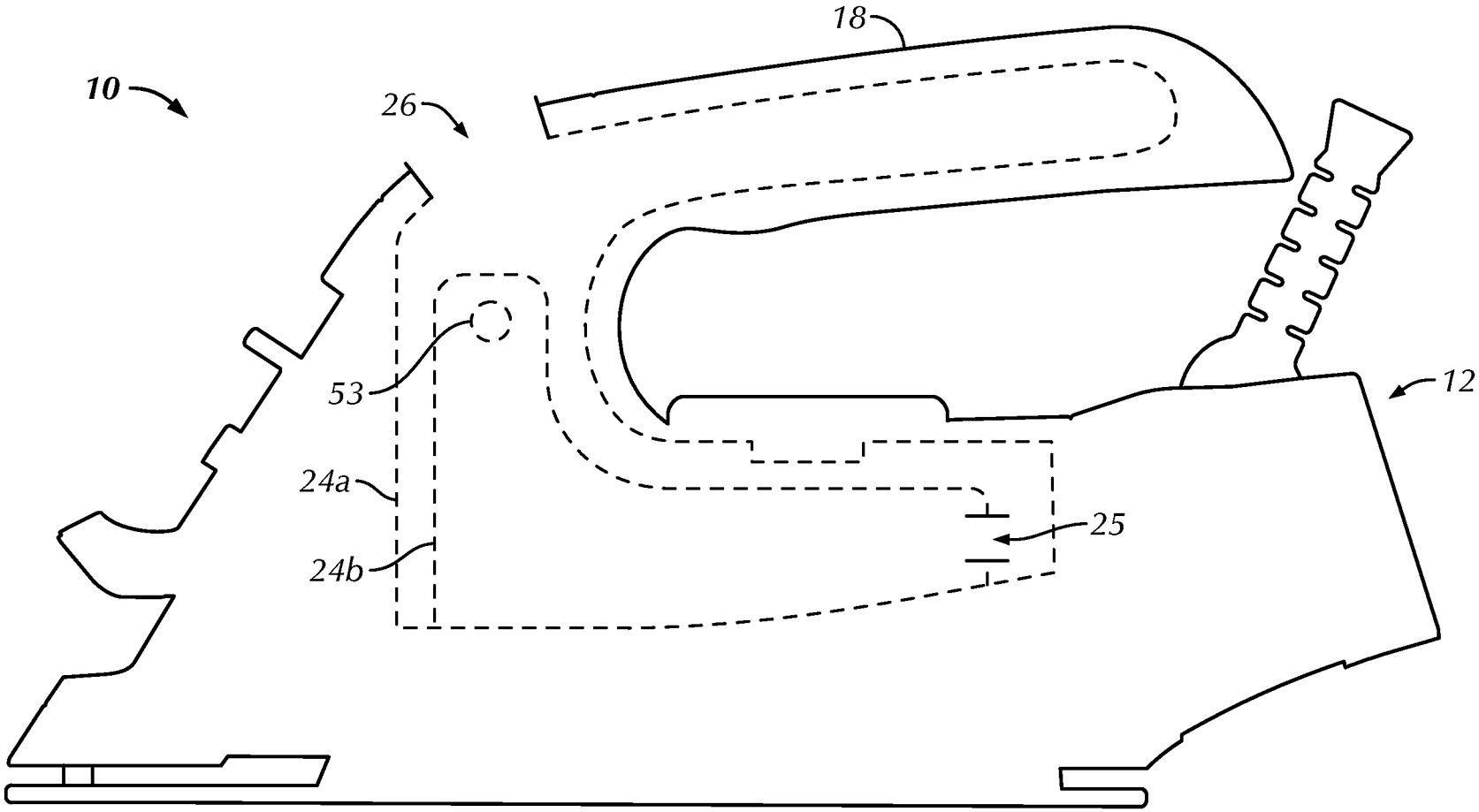
FIG. 8 is a schematic view of the iron of FIG. 1 with a divided water reservoir.

In a particular embodiment, it is desirable to keep the steam from heating the handle 18 or remainder of the housing 12 to a point that is uncomfortably warm or hot for the user. Thus, as shown schematically in FIG. 8, the water reservoir may be divided into an outer reservoir 24*a* and an inner reservoir 24*b*. The inner reservoir 24*b* is confined to a more central location of the housing 12, while the outer reservoir 24*a* may extend into the handle 18 and proximate surfaces of the housing 12 that the user may encounter during normal operation. The feedback tube 52 (not shown in FIG. 8) may connect to an opening 53 that allows the steam to enter into the inner reservoir 24*b*. In addition, the inner reservoir 24*b* may have an opening 25, preferably toward a rear of the housing 12, that allows water from the outer reservoir 24*a* to flow into the inner reservoir 24*b*. Water may flow into the first and/or second steam chambers 36, 48 (not shown in FIG. 8) from either the outer or the inner reservoir 24*a*, 24*b*, as desired.

Figure 6:
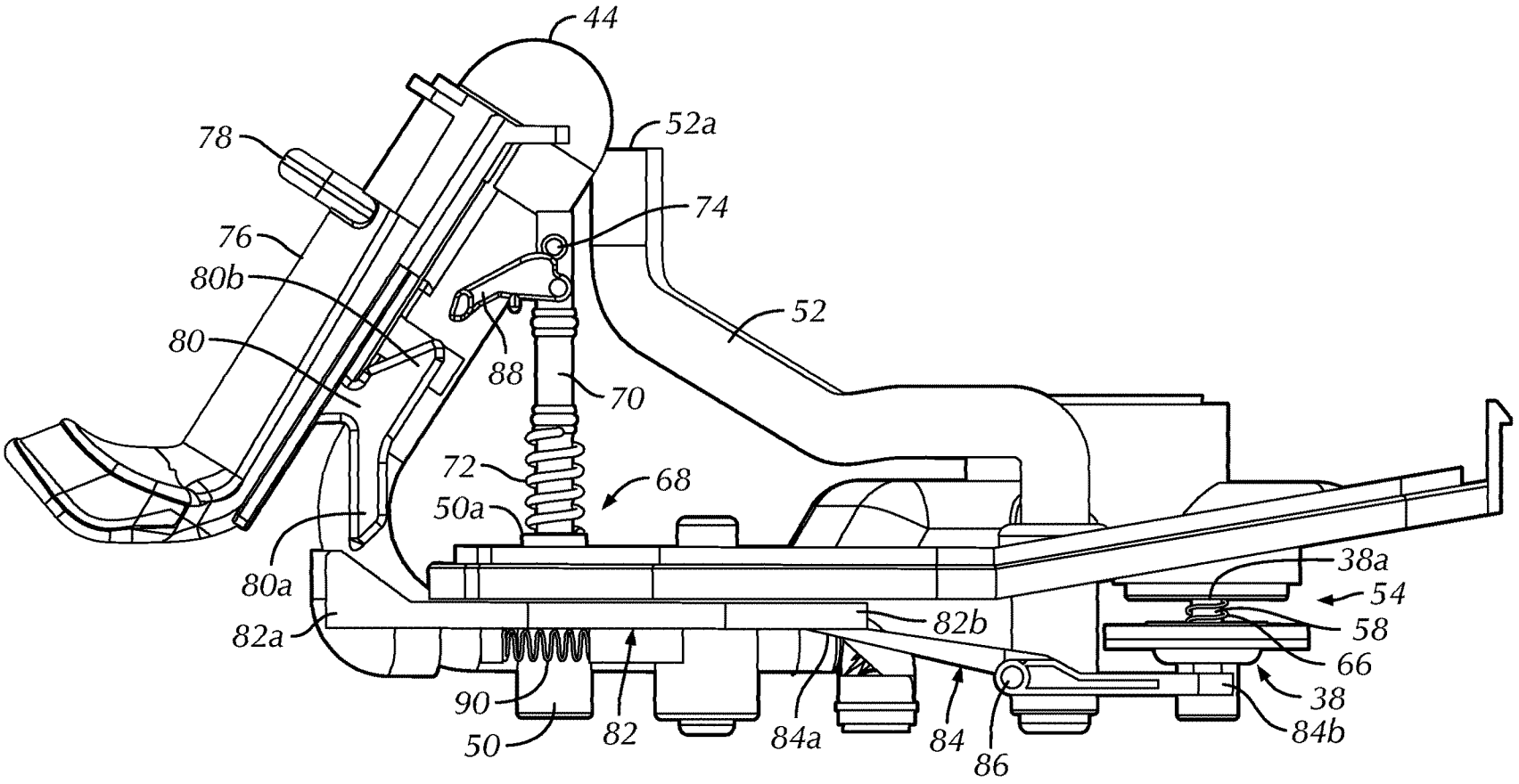
FIG. 6 is a left side elevational view of a switch and valve assembly of the iron of FIG. 1.
Figure 7:
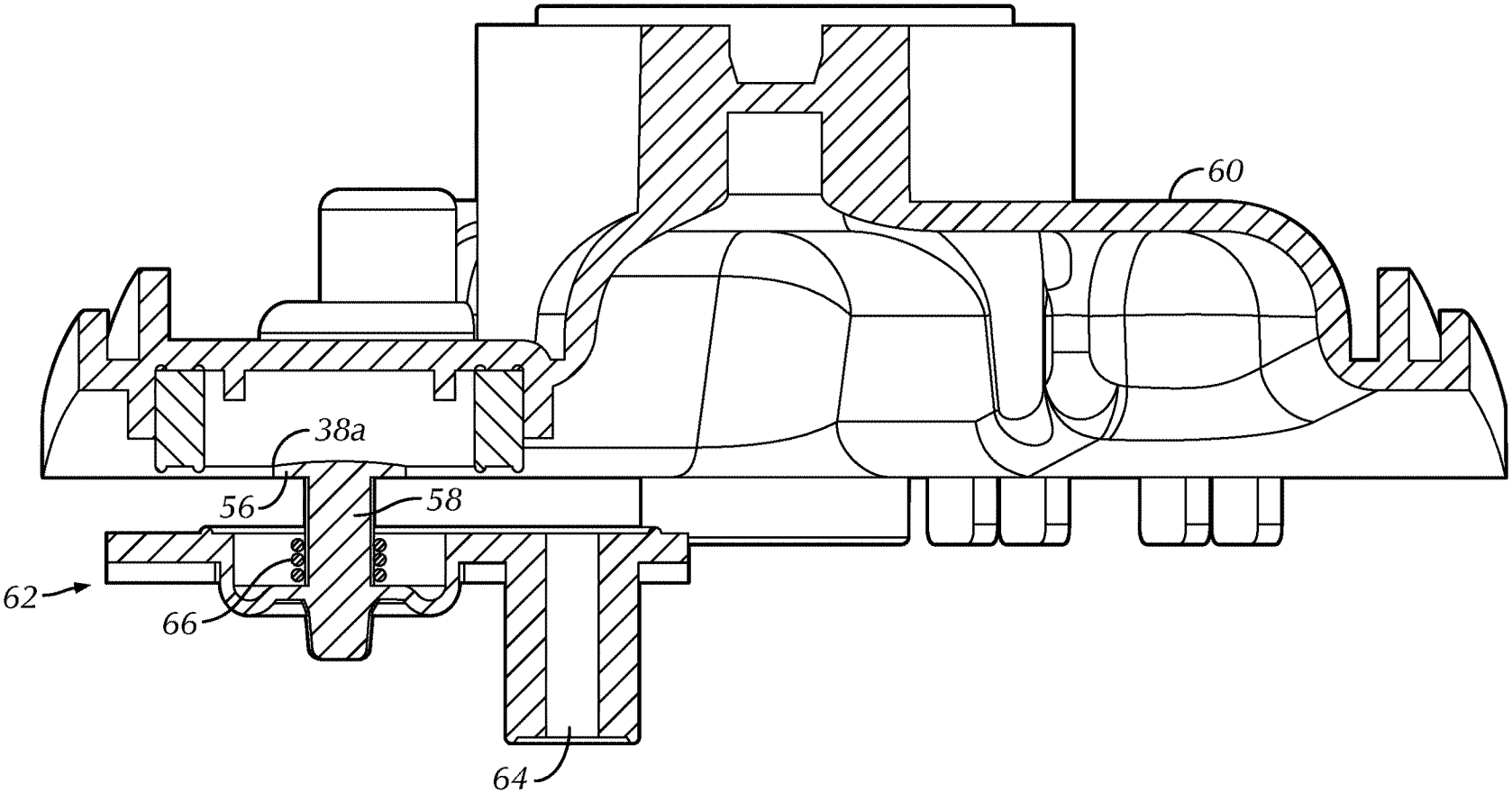
FIG. 7 is a cross-sectional back side elevational view of a valve of the iron of FIG. 1.

Referring to FIGS. 6 and 7, in order to selectively control the flow of water from the water reservoir 24 to the first steam chamber 36, a first valve 54 is provided coupled to the first feed channel 38. The first valve 54 preferably includes a plug 56 that is sized to seal the inlet 38*a* of the first feed channel 38, and is preferably formed of a polymeric material. The plug 56 may be coupled to a shaft 58 for movement therewith. As can be seen from FIG. 7, the shaft 58 and the plug 56 may be integrally formed together, although other methods of attachment may be used as well. In the embodiment shown in FIG. 7, the housing 12 includes a reservoir plate 60 which acts as a wall to seal a bottom end of the water reservoir 24. It is preferred that the inlet 38*a* of the first feed opening 38 is formed in the reservoir plate 60 and that the shaft 58 extends therethrough.

In the embodiment of FIGS. 6 and 7, the plug 56 and shaft 58 are part of an elongated bushing 62, preferably all integrally formed together of the same polymeric material, such as silicone or the like. The bushing 62 forms part of the first feed channel 38 and includes a duct 64 communicating with an opening in the chamber plate 42 to deliver water to the first steam chamber 36. A spring 66 preferably surrounds the shaft 58 of the first valve 54 and abuts the reservoir plate 60 and a surface of the bushing 62 to bias the plug 56 to the inlet 38*a* of the first feed channel 38 in a closed position, as shown in FIG. 7.

In operation, when steaming through the steam nozzle 16 is desired, the first valve 54 is opened by pressing the shaft 58 against the force of the spring 66, thereby lifting the plug 56 away from the inlet 38*a* of the first feed channel 38. As a result, water from the water reservoir 24 falls by gravity through the inlet 38 and onto the bushing 62, where it may proceed toward the duct 64 and enter the first steam chamber 36. Release of the shaft 58 allows the spring 66 to return the plug 56 to the closed position and stop the flow of water from the water reservoir 24.

Similarly, in order to selectively control the flow of water from the water reservoir 24 to the second steam chamber 48, a second valve 68 is provided coupled to the second feed channel 50. The second valve 68 preferably includes a shaft 70 that is sized to seal the inlet 50*a* of the second feed channel 50, and is preferably formed of a polymeric material. An end of the shaft 70 opposite to the inlet 50*a* of the second feed channel 50 may extend into a hollow column (not shown) formed in the housing 12. A spring 72 preferably surrounds the shaft 70 and is coupled between the column and the reservoir plate 60 to bias the shaft 70 toward the inlet 50*a* of the second feed channel 50 in the closed position (see FIG. 6). A post 74 preferably extends generally perpendicularly from the shaft 70 and can be used to move the shaft 70 against the force of the spring 72, as will be described in more detail below.

In operation, when steam ironing is desired, the second valve 68 is opened by contacting and moving the post 74, which moves the shaft 70 against the force of the spring 72, thereby lifting the shaft 70 away from the inlet 50*a* of the second feed channel 50. As a result, water from the water reservoir 24 flows into the inlet 50*a* and through the second feed channel 50 to enter the second steam chamber 48. Release of the post 74 allows the spring 72 to return the shaft 70 to the closed position and stop the flow of water from the water reservoir 24.

Although the first and second valves 54, 68 have been described in detail above and in the drawings, other types and configurations of valves may be used for selectively controlling water flow from the water reservoir 24 without departing from the spirit and scope of the disclosure.

To allow the user to selectively actuate the first and second valves 54, 68, a three-position switch 76 is preferably provided that is coupled to both of the first and second valves 54, 68. The switch 76 preferably includes a selector knob 78 that protrudes from and is slidable with respect to the housing 12. In a first position of the switch 76 (shown in FIGS. 1, 4, and 5 as having the selector knob 78 in a "middle" position), the first and second valves 54, 68 are both closed. The first position of the switch 76 is utilized for normal ironing without any steam. In a second position (preferably with the selector knob 78 at its closest point to the sole plate 14), the first valve 54 is open to allow steaming from the steam nozzle 16, and the second valve 68 is closed. In a third position (preferably with the selector knob 78 at its farthest point from the sole plate 14), the second valve 68 is open to allow steam ironing, and the first valve 54 is closed. Each of the three positions is preferably stable, i.e., the user does not need to manually hold the selector knob 78 in place during operation to maintain the opening or closing of the valves 54, 68.

Although a three-position switch is described herein, other mechanisms for controlling valve actuation, such as multiple switches, switches having more or less than three positions, or the like may be used as well. Buttons, capacitive touch screens, or other like mechanisms can also be used to control valve actuation. In addition, movement of the nozzle 16 with respect to the housing 12 may also be used as a way to operate the valves.

The switch 76 preferably includes a hook 80 that extends within the housing 12 for the purpose of interacting with the first and second valves 54, 68. For example, the hook 80 preferably includes first and second ends 80*a*, 80*b* protruding at an angle with respect to one another.

The first valve 54 preferably includes an arm 82 that is slidably coupled to and within the housing 12. The arm 82 has a first end 82*a* including an inclined portion that is selectively engageable with a first end 80*a* of the hook 80 of the switch 76. That is, as the selector knob 78 and switch 76 are moved toward the sole plate 14 to the second position, the hook 80 also moves toward the sole plate 14 and the first end 80*a* of the hook 80 engages the inclined portion of the first end 82*a* of the arm 82. As a result, the first end of the hook 80*a* slides along the inclined portion of the first end 82*a* of the arm 82 and pulls the arm 82 away from the first feed channel 38. A spring 90 is preferably provided to bias the arm 82 toward the first feed channel 38 so that in the absence of the switch 76 being in the second position, the arm 82 maintains the first valve 54 in a closed state.

A second end 82*b* of the arm 82 is preferably coupled to a first end 84*a* of a rotatable lever 84 such that sliding motion of the arm 82 with respect to the housing 12, caused by the actuation of the switch 76, results in rotation of the rotatable lever 84 about a pivot 86. A second end 84*b* of the rotatable lever 84 is preferably coupled to the shaft 58 of the first valve 54. As the arm 82 is pulled away from the first feed channel 38, the second end 84*b* of the rotatable lever 84 presses against the shaft 58 of the first valve 54 and against the bias of the spring 66 to move the plug 56 away from the inlet 38*a* of the first feed channel 38. This state is maintained while the switch 76 is in the second position. Once the switch 76 is moved away from the second position and the hook 80 releases the arm 82, the rotatable lever 84 is permitted to release pressure on the shaft 58, which allows the spring 66 to close the first valve 54.

The second valve 68 preferably includes a cam 88 that is movably couplable to the shaft 70 thereof for interaction with the switch 76. Preferably, the cam 88 abuts and interacts with the post 74 extending from the shaft 70. The cam 88 is selectively engageable with the second end 80*b* of the hook 80. As the selector knob 78 and the switch 76 are moved away from the sole plate 14 and toward the third position, the second end 80*b* of the hook 80 and engages and rotates the cam 88. As the cam 88 rotates, the post 74 is pressed away from the second feed channel 50 by the cam 88 and the shaft 70 accordingly is moved away from the inlet of the second feed channel 50, thereby opening the second valve 68 and allowing the water to flow by gravity from the water reservoir 24 to the second steam chamber 48. This state is maintained while the switch 76 is in the third position. Once the switch 76 is moved away from the third position and the hook 80 releases the cam 88, the shaft 70 is moved back into the inlet of the second feed channel 50 to close the second valve 68.

Figure 9:
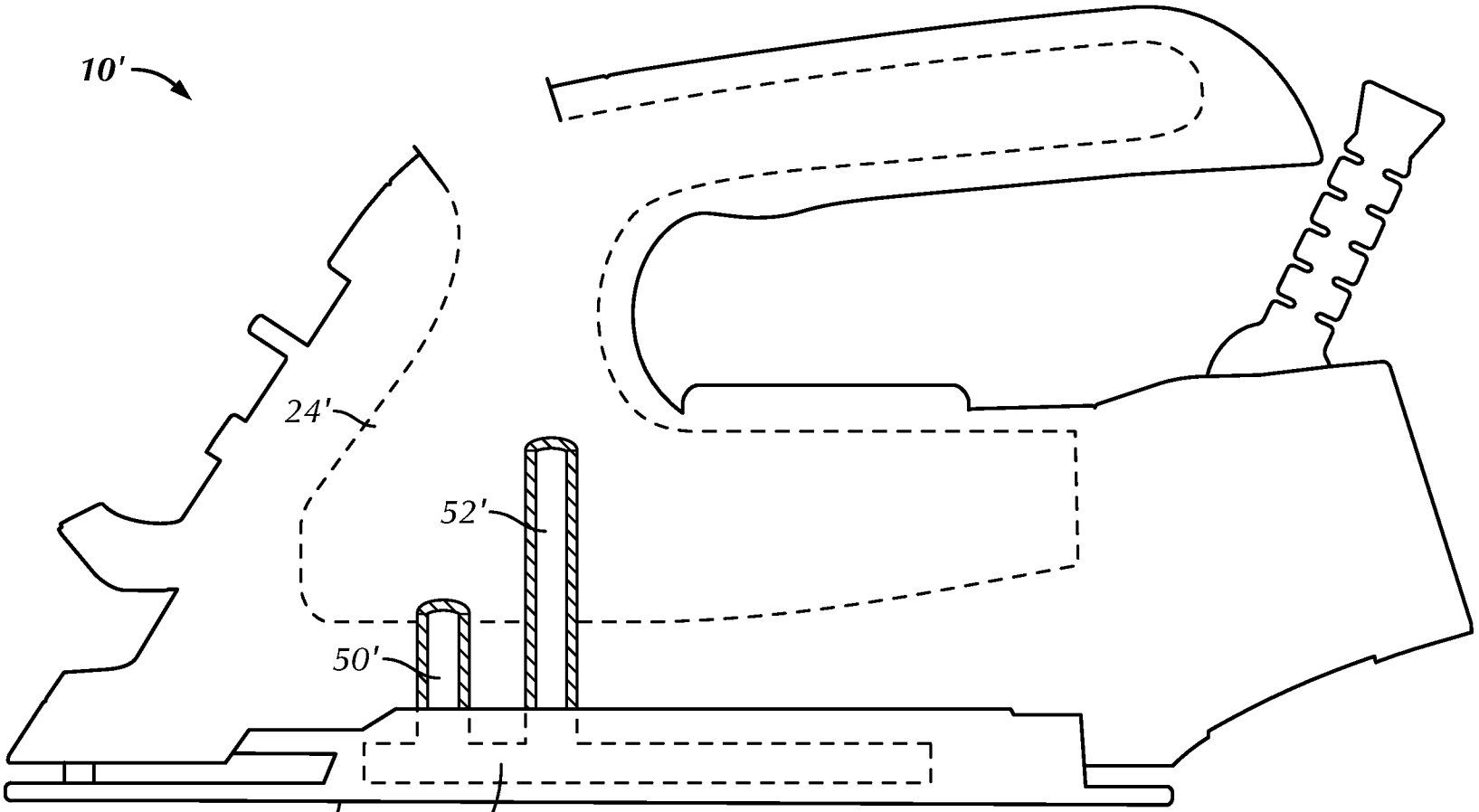
FIG. 9 is a schematic view of an iron in accordance with a second embodiment of the present disclosure.

Referring to FIG. 9, another embodiment of the present disclosure is shown in a schematic view. In particular, the iron 10' does not include a steamer function. Thus, only a single steam chamber 48' is provided in fluid communication with the water reservoir 24' via a feed channel 50' to allow for steam ironing operations. Water flowing into the steam chamber 48' is converted into steam and is emitted through the openings (not shown) in the sole plate 14'. To prevent back pressure from slowing the water flow through the preferably gravity-fed feed channel 50', a feedback tube 52' extends between the steam chamber 48' and the water reservoir 24'. In this way, a volume of the steam generated in the steam chamber 48' is passed back to the water reservoir 24', equalizing the pressures in the steam chamber 48' and the water reservoir 24'. As a result, flow through the feed channel 50' can be maintained at a generally constant rate, creating a more continuous steam flow from the holes in the sole plate 14'. Much like the first embodiment above, the feedback tube 52' preferably terminates at a predetermined distance or height from the sole plate 14'. In this way, water in the water reservoir 24' is prevented from entering into the feedback tube 52' when the sole plate 14' is oriented parallel to a support surface.

The subject disclosure including steam feedback tube could also be used for a steamer appliance where the steamer does not include a pump to displace fluid or otherwise motivate the steam from the appliance.

The iron 10' shown in FIG. 9 may further include some or all of the features of the iron 10 described above with respect to FIGS. 1-8.

From the foregoing, it can be seen that embodiments of the present disclosure comprise an iron, and particularly a combined iron and gravity-fed steamer with continuous steam generation. It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

What is claimed is:

1. A garment care appliance comprising:

a housing;

a sole plate coupled to the housing and having a plurality of openings formed therein;

a water reservoir located within the housing;

a first steam chamber in selective fluid communication with the water reservoir via a first feed channel;

a second steam chamber in selective fluid communication with the water reservoir via a second feed channel and in thermal communication with the heater, the plurality of openings in the sole plate being in fluid communication with the second steam chamber;

a heater in thermal communication with the sole plate and the first steam chamber, the heater being configured to heat the sole plate and water in the first steam chamber received from the water reservoir to generate steam and further configured to heat water in the second steam chamber received from the water reservoir to generate steam that is emitted through the plurality of openings in the sole plate;

a steam nozzle mounted to the housing and in fluid communication with the first steam chamber for emitting at least a first volume of the steam generated in the first steam chamber;

a first valve coupled to the first feed channel for selectively controlling flow of water from the water reservoir into the first steam chamber; and a second valve coupled to the second feed channel for selectively controlling flow of water from the water reservoir into the second steam chamber; and a three-position switch coupled to the first and second valves such that in a first position, the first and second valves are closed, in a second position, the first valve is open and the second valve is closed, and in a third position, the second valve is open and the first valve is closed.

2. The garment care appliance of claim 1, wherein the first valve comprises:

a plug sized to seal an inlet of the first feed channel, the plug being coupled with a shaft; and a spring abutting a wall of the housing and biasing the plug toward the inlet of the first feed channel in the closed position.

3. The garment care appliance of claim 2, wherein the switch comprises a hook extending within the housing and the first valve further comprises an arm slidably coupled to the housing and having a first end selectively engageable with the hook of the switch and a second end coupled to a first end of a rotatable lever, a second end of the lever being coupled to the shaft such that when the switch is moved to the second position, the hook engages and slides the arm, which rotates the lever, causing the second end to press the shaft and move the plug away from the inlet of the first feed channel.

4. The garment care appliance of claim 3, wherein the first end of the arm includes an inclined portion that abuts and interacts with the hook of the switch.

5. The garment care appliance of claim 1, wherein the second valve comprises:

a shaft sized to seal an inlet of the second feed channel; and a spring biasing the shaft toward the inlet of the second feed channel in the closed position.

6. The garment care appliance of claim 5, wherein the switch comprises a hook extending within the housing and the second valve further comprises a cam movably coupled to the shaft of the second valve and selectively engageable with the hook of the switch such that when the switch is moved to the third position, the hook engages and rotates the cam, which moves the shaft away from the inlet of the second feed channel.

7. The garment care appliance of claim 6, wherein the shaft of the second valve includes a post extending therefrom that abuts and interacts with the cam.

8. The garment care appliance of claim 1, wherein the switch includes a selector knob that protrudes from and is slidable with respect to the housing.

* * * * *